US009199364B2

(12) United States Patent
Ito et al.

(10) Patent No.: US 9,199,364 B2
(45) Date of Patent: Dec. 1, 2015

(54) TORQUE DRIVER

(75) Inventors: Seiji Ito, Tokyo (JP); Naoya Masuda, Tokyo (JP)

(73) Assignee: TOHNICHI MFG. CO., LTD., Tokyo (JP)

( * ) Notice: Subject to any disclaimer, the term of this patent is extended or adjusted under 35 U.S.C. 154(b) by 144 days.

(21) Appl. No.: 13/881,997

(22) PCT Filed: Aug. 6, 2012

(86) PCT No.: PCT/JP2012/004980

§ 371 (c)(1), (2), (4) Date: May 2, 2013

(87) PCT Pub. No.: WO2013/084380

PCT Pub. Date: Jun. 13, 2013

(65) Prior Publication Data

US 2014/0208899 A1 Jul. 31, 2014

(30) Foreign Application Priority Data

Dec. 7, 2011 (JP) ..... 2011-267837

(51) Int. Cl.
*B25B 23/145* (2006.01)
*B25B 23/15* (2006.01)
(Continued)

(52) U.S. Cl.
CPC ..... *B25B 23/15* (2013.01); *B25B 15/00* (2013.01); *B25B 23/1427* (2013.01); *B25B 23/145* (2013.01)

(58) Field of Classification Search
CPC .. B25B 23/15; B25B 23/1427; B25B 23/145; B25B 15/00
USPC ..... 81/468
See application file for complete search history.

(56) References Cited

U.S. PATENT DOCUMENTS 2,901,934 A * 9/1959 Dunham ..... 81/468
3,523,471 A * 8/1970 Lance ..... 81/468
(Continued)

FOREIGN PATENT DOCUMENTS

CN 2082663 U 8/1991
CN 201115944 Y 9/2008
(Continued)

OTHER PUBLICATIONS

China Patent Office, "Office Acton for CN 201280003912.3," Jul. 30, 2014.
(Continued)

*Primary Examiner* — Hadi Shakeri
*Assistant Examiner* — Danny Hong
(74) *Attorney, Agent, or Firm* — Manabu Kanesaka

(57) ABSTRACT

It is to provide a torque driver capable of bringing a marker into direct contact with a surface of a fastener member such as a screw to perform marking.

A torque driver 1 is configured such that a case 10 is rotated relative to a main shaft 20 when a tightening force applied to the case 10 is transmitted to the main shaft 20 through a torque limiter section 30 and a tightening torque on a screw 80 engaged with a bit 70 attached to a coupler 60 fixed at a tip portion of the main shaft 20 reaches a torque value set in the torque limiter section 30. The torque driver 1 includes: a marker 54 extending from an inside of the coupler 60 to a tip portion of the bit 70 along a side surface of the bit 70; and a marker activating section 40 that allows the marker 54 to move forward by utilizing rotation of the case 10 relative to the main shaft 20 so that a marker tip portion 53 is brought into contact with the screw 80 to perform marking.

4 Claims, 9 Drawing Sheets

(51) Int. Cl.
*B25B 15/00* (2006.01)
*B25B 23/142* (2006.01)

(56) References Cited

U.S. PATENT DOCUMENTS

| | | | | | |
|---|---|---|---|---|---|
| 3,662,629 | A | * | 5/1972 | Lance | 81/468 |
| 3,667,327 | A | * | 6/1972 | Lance | 81/468 |
| 3,802,301 | A | * | 4/1974 | Peterson | 81/468 |
| 3,918,609 | A | * | 11/1975 | Peterson | 222/61 |
| 4,393,734 | A | * | 7/1983 | Thorn et al. | 81/468 |
| 4,462,285 | A | * | 7/1984 | Wiltshire | 81/468 |
| 5,467,674 | A | * | 11/1995 | Thorn | 81/468 |
| 5,890,406 | A | * | 4/1999 | Thorn | 81/468 |
| 6,112,626 | A | * | 9/2000 | Risner et al. | 81/468 |
| 6,961,190 | B1 | | 11/2005 | Tamaoki et al. | |
| 7,721,631 | B2 | * | 5/2010 | Berg et al. | 81/468 |
| 2014/0165795 | A1 | * | 6/2014 | Kim et al. | 81/468 |

FOREIGN PATENT DOCUMENTS

| | | | |
|---|---|---|---|
| JP | S57-163453 | U | 10/1982 |
| JP | S59-69869 | U | 5/1984 |
| JP | S61-050774 | A | 3/1986 |
| JP | S62-68284 | A | 3/1987 |
| JP | H01-114279 | U | 7/1989 |
| JP | H06-206172 | A | 7/1994 |
| JP | H07-100771 | A | 4/1995 |
| JP | H08-090442 | A | 4/1996 |
| JP | H09-001472 | A | 1/1997 |
| JP | 2007-152483 | A | 6/2007 |
| JP | 2009-148857 | A | 7/2009 |
| JP | 2009-154260 | A | 7/2009 |
| JP | 2010-155316 | A | 7/2010 |
| WO | WO2009/069457 | A | 6/2009 |

OTHER PUBLICATIONS

Japan Patent Office, "Office Acton for JP 2011-267837," Jun. 2, 2015.

* cited by examiner

A-A ARROW VIEW

B-B ARROW VIEW

A-A ARROW VIEW

B-B ARROW VIEW

TORQUE DRIVER

FIELD

The present invention relates to a torque driver with a marker, obtained by adding a marking function to a torque driver.

BACKGROUND

As a torque driver with a marker which is obtained by adding a marking function to a torque driver, there has been proposed a torque driver made to discharge a marking ink when a screw member such as a screw or a bolt is tightened until a set torque value is reached (Patent Literature 1).

According to the torque driver with a torque limiter described in the patent literature, when the set torque value is reached, the torque limiter configured by a pair of friction plates that idle a bit engaged with a bit engagement hole such as a cross-shaped hole formed on a head of a screw member and a hand grip section of the driver, and the like is activated. Along with such an idling operation, one of the above-described friction plates is caused to vibrate along an axial direction thereof. By utilizing the vibration of this friction plate, an ink is allowed to be discharged.

CITATION LIST

Patent Literature

Patent Literature 1: Japanese Patent Application Laid-Open Publication No. Hei. 7-100771

SUMMARY

Technical Problem

According to the conventional torque driver with a marker, the marking ink is discharged by the idling operation such that an operator holding the hand grip section of the driver further continues to turn the driver after the set torque value is reached. Thus, a discharged amount of the marking ink may be varied depending on an idling angle. A density difference therefore may occur in the marking, resulting in inconsistent densities.

An object of the present invention is to provide a torque driver capable of bringing a marker into direct contact with a surface of a fastener member such as a screw to perform marking.

Solution to Problem

Referring to an embodiment shown in FIG. 1, a configuration to achieve the object of the present invention relates to a torque driver 1 such that a case 10 is rotated relative to a main shaft 20 when a tightening force applied to the case 10 is transmitted to the main shaft 20 through a torque limiter section 30 and a tightening torque on a screw 80 engaged with a bit 70 attached to a coupler 60 fixed at a tip portion of the main shaft 20 reaches a torque value set in the torque limiter section 30. The torque driver 1 includes: a marker 54 extending from an inside of the coupler 60 to a tip portion of the bit 70 along a side surface of the bit 70; and a marker activating section 40 that allows the marker 54 to move forward by utilizing rotation of the case 10 relative to the main shaft 20 so that a marker tip portion 53 is brought into contact with the screw 80 to perform marking.

Advantageous Effects of Invention

According to the present invention, the following effects can be obtained.

(1) When a screw is tightened while holding the case of the torque driver and the set torque value is reached, the marker disposed on the side surface of the bit is moved forward, so that a marking section at the marker tip portion is brought into direct contact with a head of a screw to perform marking.

(2) According to an invention according to claim 2, the marker can be moved forward smoothly by utilizing repulsive magnetic forces of permanent magnets as the marker activating section.

(3) According to an invention according to claim 3, by utilizing a screwed configuration of a multiple-thread screw as the marker activating section, a rotative force thereof can be smoothly converted into a translatory movement in an axial direction, whereby the marker can be reliably moved forward.

(4) According to an invention according to claim 4, by utilizing a cam configuration as the marker activating section, a rotative force thereof can be smoothly converted into a translatory movement in an axial direction with a simple configuration, whereby the marker can be reliably moved forward.

(5) According to an invention according to claim 5, the marker is supported between an activating member and the bit through a spring, whereby a policy error or the like can be absorbed and thus the marker can be moved forward without a failure.

(6) According to an invention according to claim 6, the marker can be removed and attached easily and marking can be performed at a position easy to see since the marking is performed on a surface of the screw head.

(7) According to an invention according to claim 7, it is possible to prevent the marking section at the marker tip portion from being dried by putting a cap on when not in use.

DESCRIPTION OF EMBODIMENTS

Figure 1A:
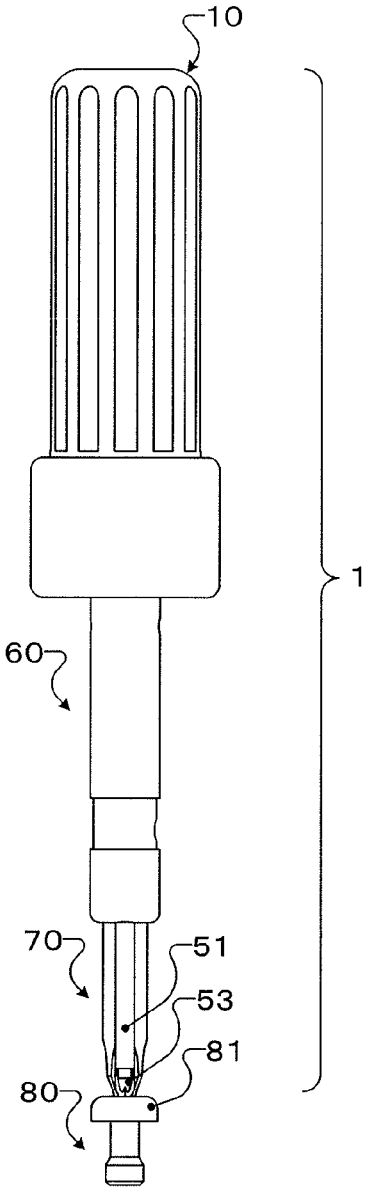
FIG. 1 shows a state of a torque driver with a marker according to a first embodiment before tightening is performed, wherein (a) shows an external front view thereof and (b) shows a longitudinal cross-sectional view of (a).

The present invention will be described below based on embodiments shown in the drawings.

Figure 1B:
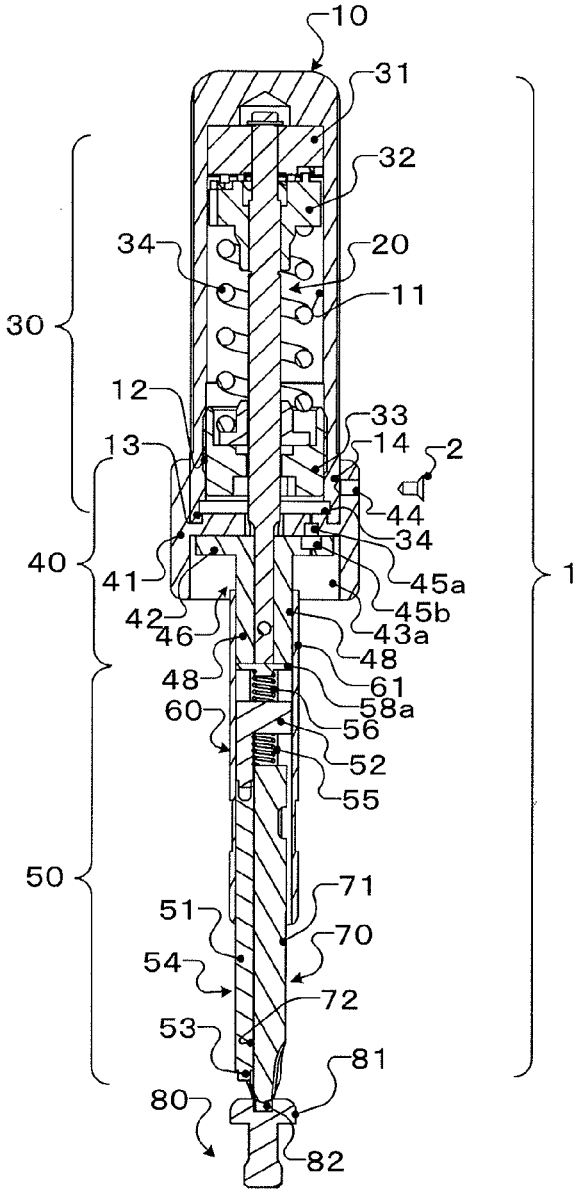
Figure 2A:
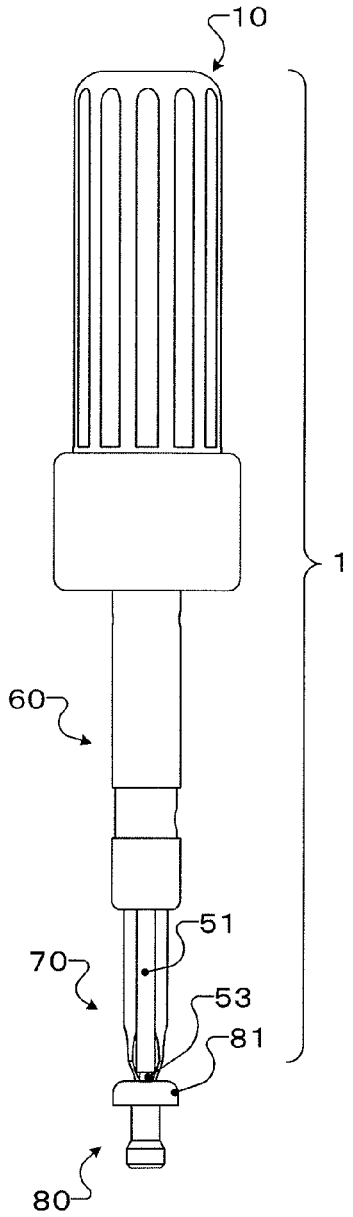
FIG. 2 shows a state of the torque driver with a marker of FIG. 1 after tightening is performed, wherein (a) shows an external front view thereof and (b) shows a longitudinal cross-sectional view of (a).
Figure 2B:
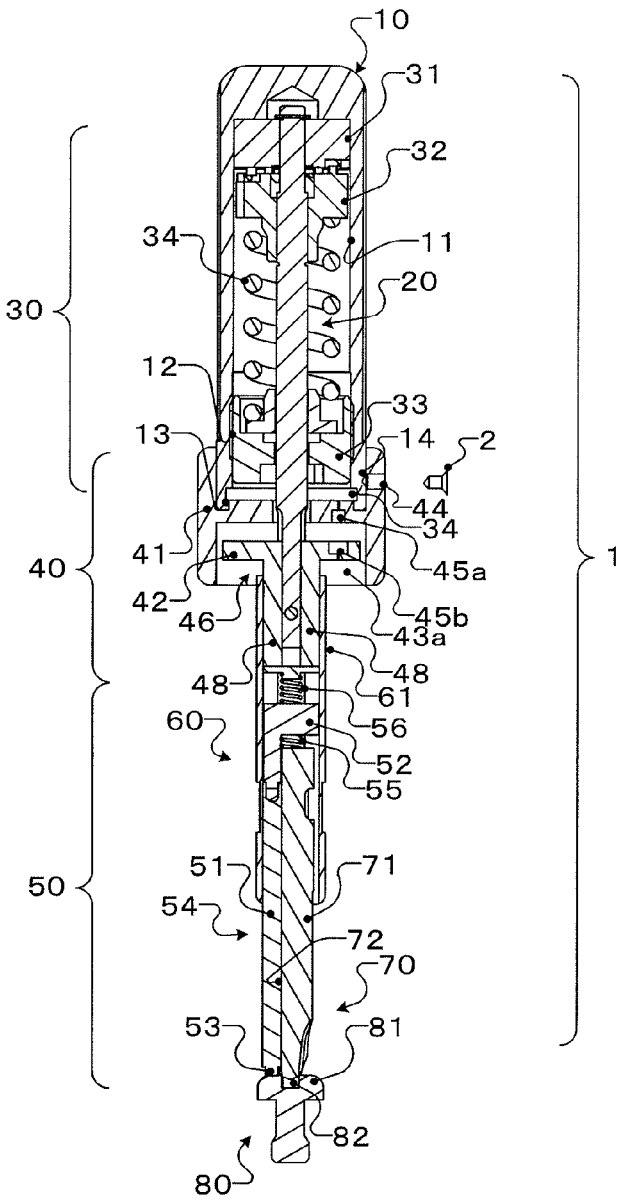

FIGS. 1 to 6 illustrate a first embodiment of the present invention. FIG. 1 shows an entire configuration of a torque driver with a marker in a state before an activation of the marker, wherein (a) shows an external view thereof and (b) shows a longitudinal cross-sectional view thereof. FIG. 2 shows an entire configuration of the torque driver with a marker in a state after the activation of the marker, wherein (a) shows an external view thereof and (b) shows a longitudinal cross-sectional view thereof.

A torque driver with a marker (hereinafter, abbreviated simply to a "torque driver") 1 includes: a case 10 formed in a tubular shape with a bottom so as to serve as a hand grip section; a main shaft 20; a torque limiter section 30 disposed within the case 10; a marker activating section 40 disposed at a tip portion of the case 10; a marker section 50 having a marker 54 to be moved in an axial direction by the marker activating section 40; and a coupler 60 to which a bit 70 is attached in a replaceable manner, to which the marker section 50 is internally attached, and with which the main shaft 20 is coupled. A tip portion of the bit 70 is engaged with a bit engagement hole 82 formed on a head 81 of a screw 80 as a fastener member.

When the torque driver 1 of the present embodiment is turned in a predetermined tightening direction while holding the case 10, a tightening torque is transmitted to the bit 70 attached to the coupler 60 through the torque limiter 30 and the main shaft 20. As a result, the tightening of the screw 80 is started. When a set torque value is reached, the torque limiter 30 is then operated so that the main shaft 20 and the case 10 are rotated relative to each other.

By utilizing the relative rotation between the main shaft 20 and the case 10 caused by the operation of the torque limiter 30 when the set torque value is reached, the marker activating section 40 brings a marking section 53 provided at a tip of the marker 54 into contact with the head 81 of the screw 80 so as to perform marking.

The torque limiter 30 is configured such that a toggle rest 31 disposed on a back surface within an inner diameter portion 11 of the case 10 in a manner such that it is incapable of rotating in the axial direction and a toggle seat 32 incapable of rotating with respect to the main shaft 20 and capable of moving in the axial direction for example by being spline-engaged with the main shaft 20 passing through a central axis portion are disposed so as to be opposed to each other and a plurality of toggles (not shown) each formed in a rod shape are disposed on opposing surfaces of the toggle rest 31 and the toggle seat 32. Toggle recesses (not shown), with which ends of the toggles to be in abutment, are formed on the opposing surfaces of the toggle rest 31 and the toggle seat 32 so as to be opposed to one another. As the relative rotation between the toggle rest 31 and the toggle seat 32 proceeds, the opposing toggle recesses approach toward a direction at which they directly face one another. As a result, the toggles disposed between the opposing toggle recesses stand up along the axial direction, thereby causing the toggle seat 32 to move in the axial direction toward the side of the bit 70.

An inner peripheral screw 12 is formed at a tip portion of the inner diameter portion 11 of the case 10, and a spring seat 33 is screw-joined therewith. A torque value setting spring 34 for setting a torque value is disposed between the spring seat 33 and the toggle seat 32. The set torque value can be changed by adjusting an axial position of the spring seat 33. In addition, an inner peripheral groove portion 13 is formed at the tip portion of the inner diameter portion 11 of the case 10, and a C-shaped member 34, for example, is engaged with the inner peripheral groove 13 so as to prevent the spring seat 33 from coming off.

The toggle seat 32 is biased against the toggle rest 31 by the spring force of the torque value setting spring 34. Thus, if the bit 70 is removed from the screw 80, a load is eliminated and the toggle seat 32 thereby approaches to the toggle rest 31 while being rotated together with the main shaft 20 in a reverse direction. As a result, the toggles are slanted toward an orthogonal direction with respect to the axial direction of the main shaft 20. Note that the torque limiter 30 is not limited to the configuration employing the rod-shaped toggles. The torque limiter 30 may have a configuration such that: a steel ball is used; one of toggle recesses formed on the toggle rest 31 and the toggle seat 32 is used as a cam recess; the other is used as a steel ball fitting recess into which the steel ball is fitted with allowance; and the steel ball is partially fitted into the cam recess and the steel ball fitting recess. With this steel ball system, the steel ball comes into contact with a cam face formed in the cam recess, and the toggle seat 32 is moved in a forward direction when the steel ball being in contact with the cam face is moved toward the toggle seat 32 along the cam face.

An activation principle of the marker activating section 40 according to the present embodiment is such that in a case where magnetic poles of opposing permanent magnets are set to the same pole (the south pole and the south pole, or the north pole and the north pole) with one of the magnets being fixed in the axial direction and about the axis of the main shaft 20 and the other magnet being movable in the axial direction and about the axis of the main shaft 20, the other magnet receives no repulsive magnetic force from the one of the magnets and no repulsive force receding along the axial direction from the one of the magnets if a phase shift exists between the opposing permanent magnets in a direction about the axis, but the other magnet generates a moving force for moving in a direction receding along the axial direction of the main shaft 20 due to the repulsive magnetic force if the above-described phases coincide to each other.

As shown in FIGS. 1, 2, and 6, the marker activating section 40 is divided into two chambers, a front chamber 43*a* and a rear chamber 43*b*, by a partition wall 42 on a front side and a rear side in the axial direction within a cylindrically-shaped fixed section 41 externally attached to the tip portion of the case 10. The rear chamber 43*b* is being fitted to the tip portion of the case 10. A screw-engaged circumferential groove 14 is formed in a circumferential direction along the entire circumference on an outer peripheral surface of the tip portion of the case 10. A plurality of screw holes 44 into which screws 2 are screwed are formed in the circumferential direction on a peripheral wall of the rear chamber 43*b*. The screws 2 are screwed into the screw holes 44 and tips of the screws 2 are screwed also into the screw-engaged circumferential groove 14 so as to fix the fixed section 41 at a desired position in the circumferential direction in a manner such that it is incapable of moving in the axial direction.

A plurality of first permanent magnets 45*a* are fixed on the partition wall 42 at regular intervals along a concentric circle (radius r) with a shaft center being at its center, for example, so as to face the front chamber 43*a*. The first permanent magnet 45*a* sets the magnetic pole facing the front chamber 43*a* to the north pole, for example. Moreover, third permanent magnets 45*c* are fixed on the above-described concentric circle so as to be adjacent to the first permanent magnets 45*a*. The magnetic pole position of this third permanent magnet 45*c* is arranged so as to be opposite to that of the first permanent magnet 45*a*. In the present embodiment, the magnetic pole of the third permanent magnet 45*c* facing the front chamber 43*a* is set to the south pole opposite to that of the first permanent magnet 45*a*. As a material for the fixed section 41, a non-magnetic material such as a synthetic resin is used at least for the partition wall 42.

A through hole 42*a* for the main shaft 20 to be passed therethrough is formed in an axial center portion of the partition wall 42, and the main shaft 20 having passed through the through hole 42*a* of the partition wall 42 extends to the anterior side of the fixed section 41.

An activating member 46 is provided into the front chamber 43*a*. The activating member 46 is provided so as to be incapable of rotating about the axis of the main shaft 20 and capable of moving in the axial direction thereof. The activating member 46 has a substrate 47 formed in a disk shape and two activating rods 48 each in a cylindrical shape, for example, extending in the axial direction toward the anterior side from the front surface side of the substrate 47. A through hole 47*a* for the main shaft 20 to be passed therethrough is formed in the substrate 47. The activating rods 48 are disposed symmetrically with respect to the shaft center so as to enter parts of the through hole 47*a*. The parts of the activating rods 48 entering the through hole 47 are referred to as engaged protruding threads 48*a*.

Figure 3A:
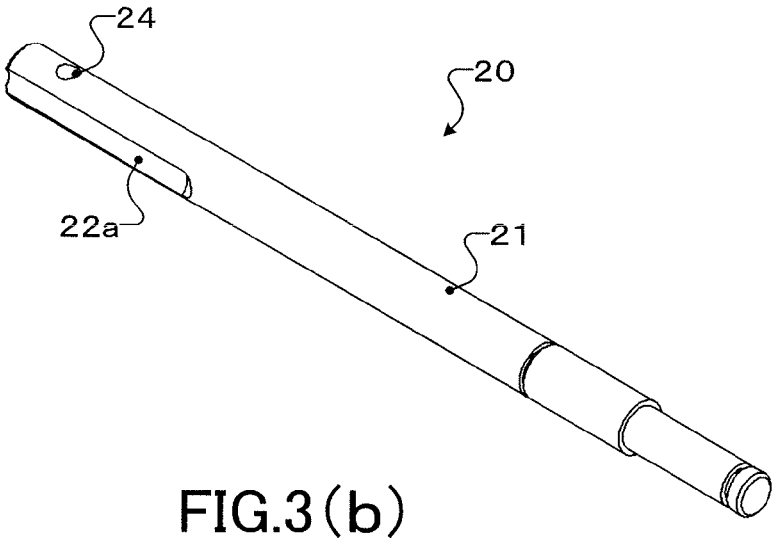
FIG. 3 shows a main shaft of FIG. 1, wherein (a) shows an external perspective view thereof, (b) shows a front view thereof, and (c) shows a left side view of (b).
Figure 3B:
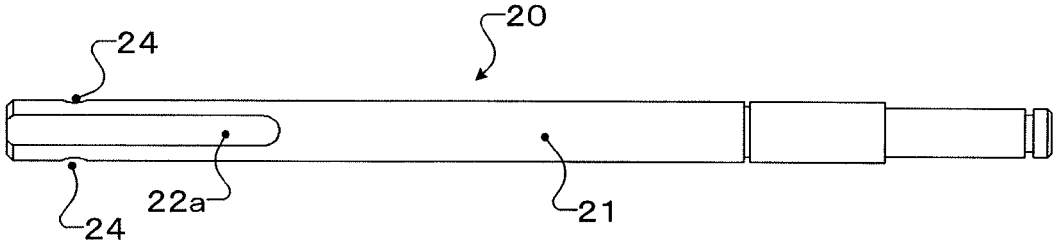
Figure 3C:
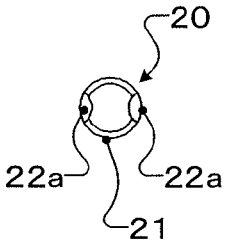
Figure 4A:
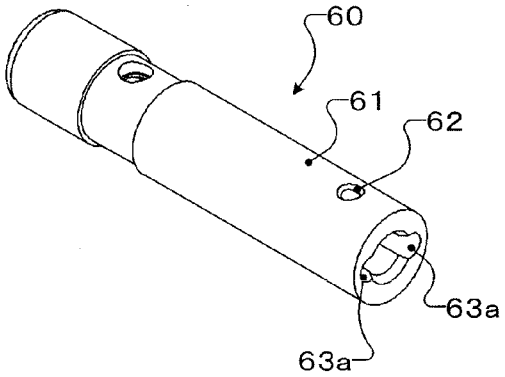
FIG. 4 shows a coupler of FIG. 1, wherein (a) shows an external perspective view thereof, (b) shows a front view thereof, (c) shows a right side view of (b), and (d) shows a left side view of (b).
Figure 4D:
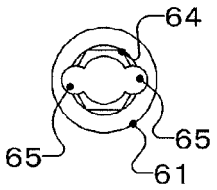
Figure 4B:
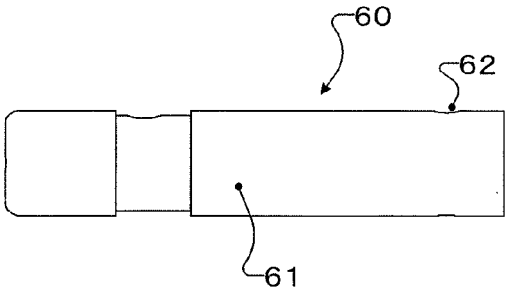
Figure 4C:
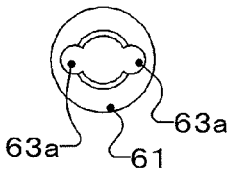
Figure 5A:
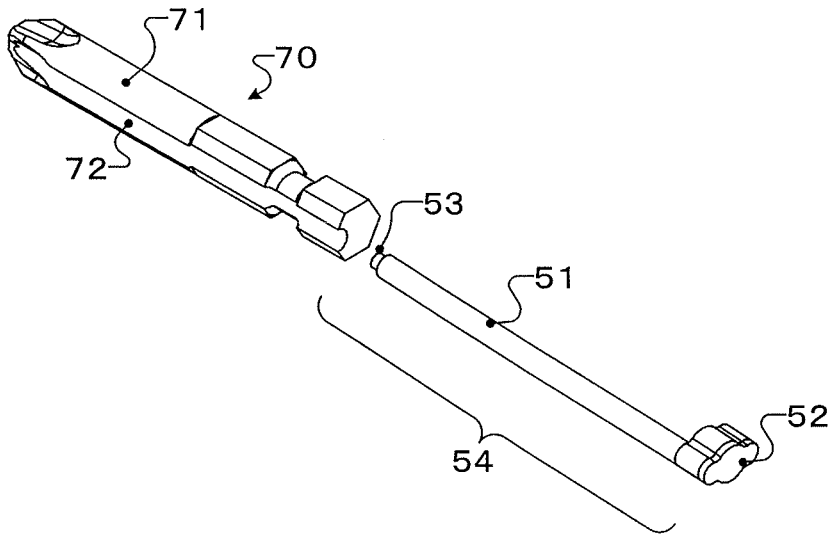
FIG. 5 shows a bit of FIG. 1, wherein (a) shows an external perspective view illustrating a fitting relationship with a marker, (b) shows a front view thereof, (c) shows a right side view of (b), and (d) shows a left side view of (b).
Figure 5D:
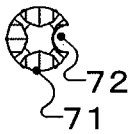
Figure 5B:
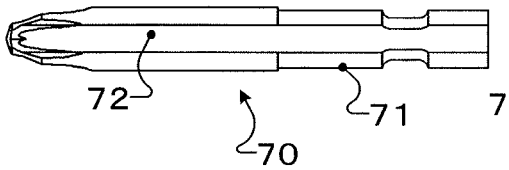
Figure 5C:
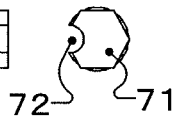
Figure 6C:
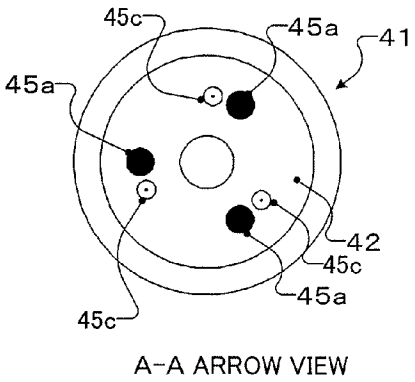
FIG. 6 shows a marker activating section of FIG. 1, wherein (a) shows an external exploded perspective view thereof, (b) shows an exploded view of a fixed section illustrated with a longitudinal cross-section thereof and an activating member illustrated in a front view, (c) shows an A-A arrow view of (b), and (d) shows a B-B arrow view of (b).
Figure 6B:
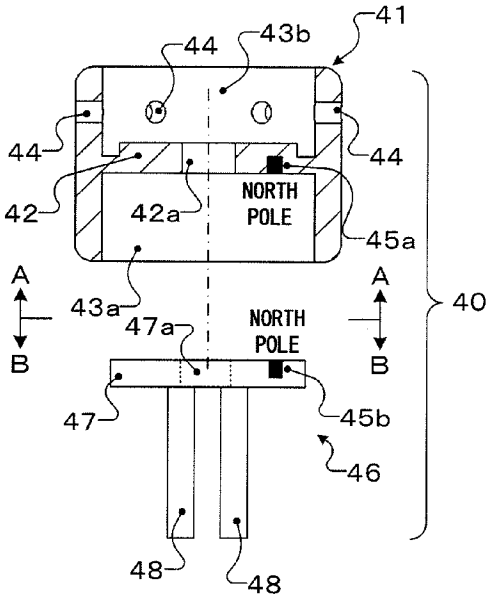
Figure 6D:
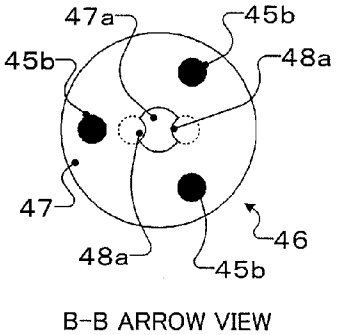
Figure 6A:
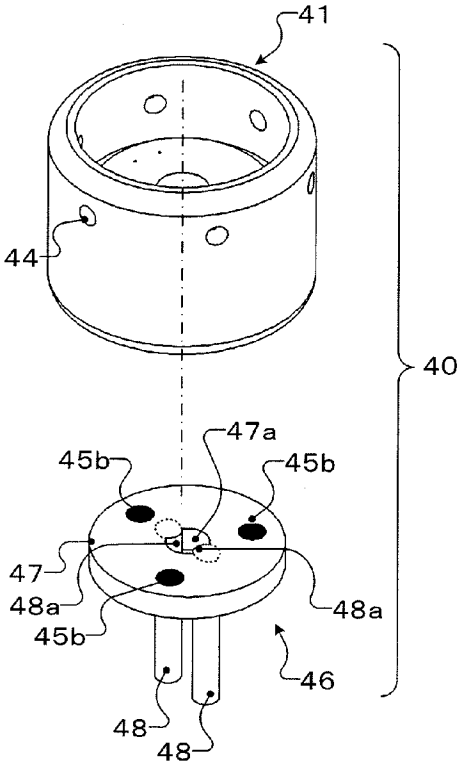
Figure 7A:
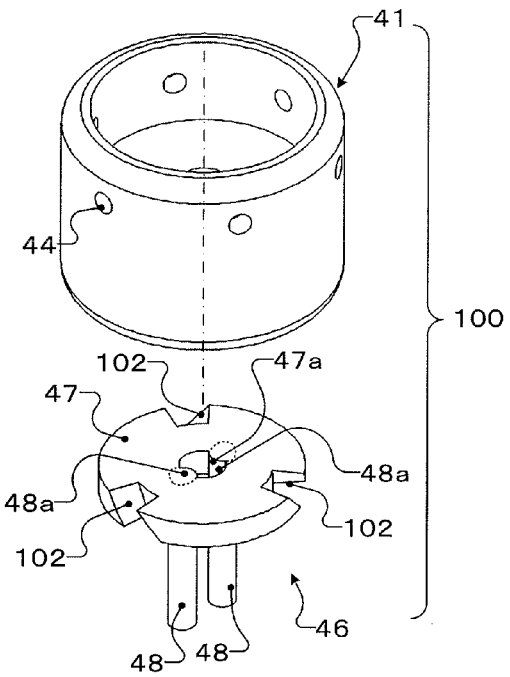
FIG. 7 shows a second embodiment of the marker activating section, wherein (a) shows an external exploded perspective view thereof, (b) shows an exploded view of a fixed section illustrated with a longitudinal cross-section thereof and an activating member illustrated in a front view, (c) shows an A-A arrow view of (b), and (d) shows a B-B arrow view of (b).
Figure 7B:
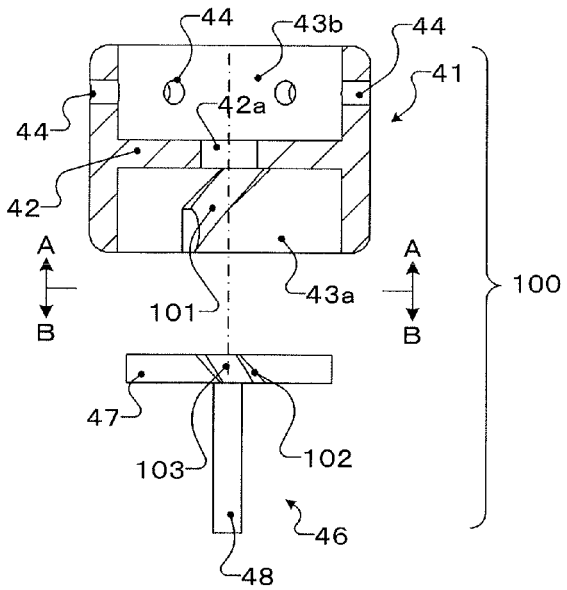
Figure 7C:
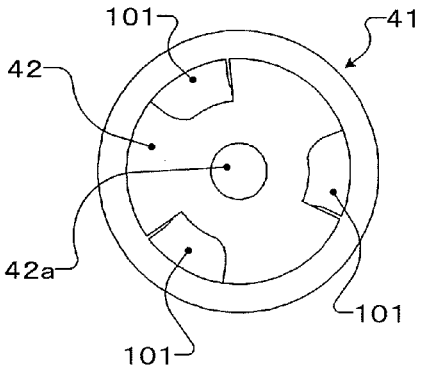
Figure 7D:
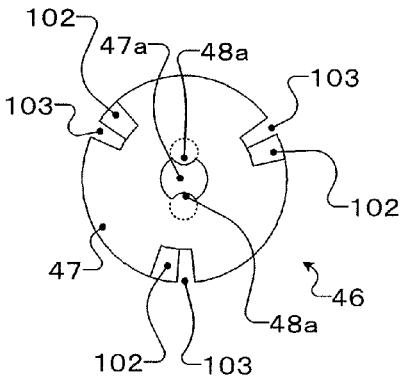
Figure 8A:
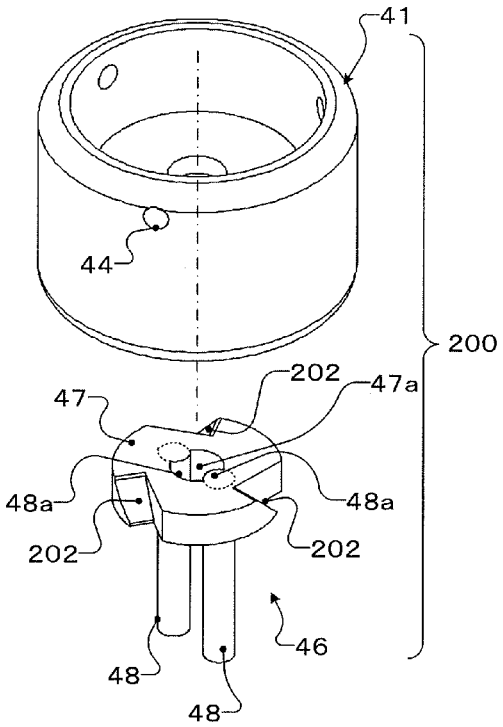
FIG. 8 shows a third embodiment of the marker activating section, wherein (a) shows an external exploded perspective view thereof, (b) shows an exploded view of a fixed section illustrated with a longitudinal cross-section thereof and an activating member illustrated in a front view, (c) shows an A-A arrow view of (b), and (d) shows a B-B arrow view of (b).
Figure 8B:
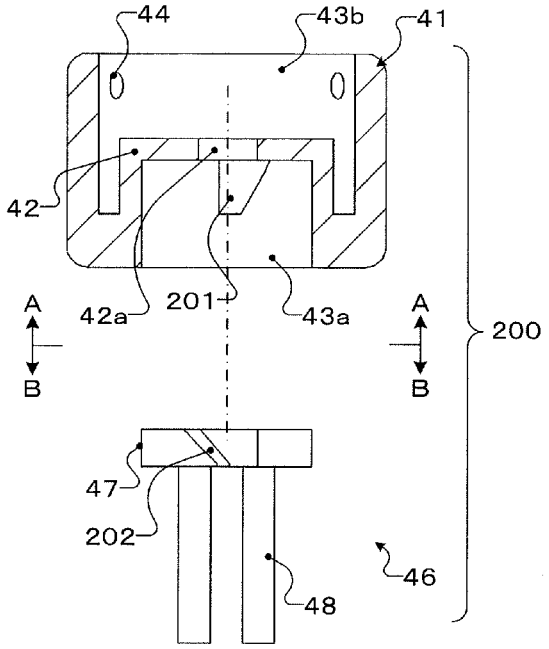
Figure 8C:
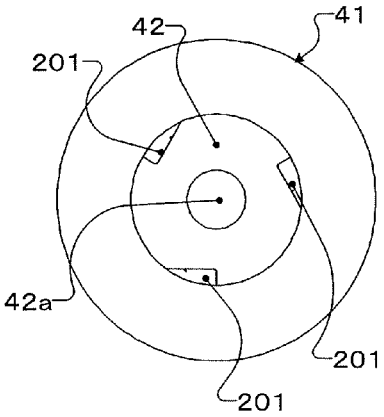
Figure 8D:
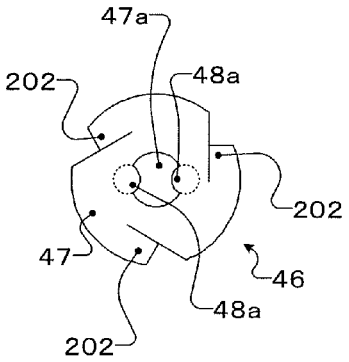

As shown in FIG. 3, the main shaft 20 has long groove portions 22*a* formed so as to be opposed to each other symmetrically with respect to the shaft center on an outer peripheral surface at a tip portion of a shaft main body 21. In the activating member 46, the main shaft 20 is inserted into the through hole 47*a* with the long groove portions 22*a* of the main shaft 20 being aligned with the engaged protruding threads 48*a*. As a result, a rotation about the axis of the main shaft 20 is restricted. On the other hand, the engaged protruding threads 48*a* are inserted into the long groove portions 22*a* of the main shaft 20 in a manner such that they are capable of sliding along the axial direction.

In screw fastening, although the fixed section 41 is rotated past a second position at which the set torque value is reached starting from a first position at which no load is applied to the activating member 46, the fixed section 41 activates the marker section 50 so that marking can be performed when the position of the fixed section 41 reaches the second position.

A plurality of second permanent magnets 45*b* are disposed on the substrate 47 of the activating member 46 facing the partition wall 42 at the same intervals along a circle with the same radius r as those of the first permanent magnets 45*a* so as to be opposed to the first permanent magnets 45*a*. The magnetic pole of the second permanent magnet 45*b* facing the first permanent magnet 45*a* is set to the same magnetic pole as that of the first permanent magnet 45*a*, e.g., the north pole. As a material for the substrate 47, the activating member 46 employs a non-magnetic material such as a synthetic resin at least for the substrate 47.

The first permanent magnets 45*a* in the fixed section 41 and the plurality of second permanent magnets 45*b* in the activating member 46 are relatively rotated between a first (phase) position at which they are shifted from one another about the axis and a second (phase) position at which they directly face each other. The first permanent magnets 45*a* and the second permanent magnets 45*b* are arranged such that they are placed at the first phase position in a non-fastened state where the screw 80 is not being tightened and at the second phase position in a tightening completed state at which the torque limiter 30 is activated. At the first phase position, the second permanent magnets 45*b* directly face the third permanent magnets 45*c*, thereby being magnetically adsorbed thereto by the magnetic force.

More specifically, the tightening torque is increased along with the tightening of the screw 80, and the torque limiter 30 is operated when the set torque value is reached. As a result, the case 10 held by an operator is rotated in the tightening direction with respect to the main shaft 20. Thus, the fixed section 41 integrally fixed with the case 10 is rotated about the axis with respect to the activating member 46. As a result, the third permanent magnets 45*c* being magnetically adsorbed to the second permanent magnets 45*b* at the first phase position are moved by breaking the adsorption force with the second permanent magnets 45*b* due to the magnetic force, and the phase is then changed to the second phase position at which the first permanent magnets 45*a* and the second permanent magnets 45*b* directly face one another. When the fixed section 41 reaches the second phase position, the plurality of first permanent magnets 45*a* and the plurality of second permanent magnets 45*b* directly face one another. Thus, a repulsive force is generated between the same poles of the permanent magnets, thereby moving the activating member 46 toward the anterior side along the axial direction with the engaged protruding threads 48*a* being guided by the long groove portions 22*a* of the main shaft 20.

According to the present embodiment, tips of the activating rods 48 are at the same position with the tip of the main shaft 20 in the first phase position. In the second phase position, however, they reach positions more anterior than the tip of the main shaft 20, thereby pushing the marker 54 of the marker section 50 toward the anterior side in the axial direction.

The marker section 50 of the present embodiment is disposed within the coupler 60, which is removably fixed at the tip portion of the main shaft 20, and on a side surface of the bit 70.

As shown in FIG. 4, in the coupler 60, the tip portion of the main shaft 20 is inserted into a posterior end of a coupler main body 61 formed in a cylindrical shape. Then, a fixing pin (not shown) screwed into the inside of the coupler 60 through a pin hole 62 formed on a peripheral wall portion of the coupler 60 is fitted into a depressed portion 24 of the main shaft 20 as shown in FIG. 3. As a result, the coupler 60 is fixed to the tip portion of the main shaft 20.

Fitting grooves 63*a* into which the two activating rods 48 protruding from the long groove portions 22*a* of the main shaft 20 are fitted are formed on an inner peripheral surface of the coupler 60 on the side of the posterior end thereof.

In an inner diameter portion 64 at a tip portion of the coupler 60, there is formed an angle hole into which the bit 70 formed in a hexagon shank as shown in FIG. 5 is fitted.

In the present embodiment, the marker section 50 includes: an ink tank section 52 for accommodating an ink, removably attached to a posterior end of an elongated cylindrical marker main body 51; and the marker 54 having the marking section 53 with an application member such as felt being attached to a tip of the marker main body 51 as shown in FIG. 5(*a*). The ink inside the ink tank section 52 is supplied to the marking section 53 through the inside of the marker main body 51. In a state where the marker main body 51 is removed from the ink tank section 52, the ink tank section 52 can be filled with an ink through a hole portion (not shown) into which the marker main body 51 is to be inserted.

The marker 54 places the ink tank section 52 between a posterior end of a bit main body 71 of the bit 70 and the tips of the activating rods 48 inside the coupler main body 61. Then, a first spring 55 formed by a coil spring is disposed between the ink tank section 52 and the posterior end of the bit main body 71, and a second spring 56 formed by a coil spring is disposed between the ink tank section 52 and the activating rods 48. The marker 54 is thereby held without rattle. A spring constant of the second spring 56 is set to be larger than that of the first spring 55. Therefore, when the second spring 56 moves toward the anterior side of the activating rods 48 in the axial direction, the marker 54 is moved and transferred toward the anterior side in the axial direction while compressing the first spring 55. At the moment when the set torque value is reached, the activating rods 48 are moved toward the anterior side in the axial direction so as to perform marking by the marker 54. Furthermore, if the case 10 and the main shaft 20 are returned to the first phase position, the first permanent magnets 45*a* and the second permanent magnets 45*b* are returned to their original phase from the second phase position to the first phase position. The activating rods 48 are also returned to the original position together with the marker 54 due to the spring force of the first spring 55.

The marker 54 of the present embodiment is configured such that the ink is passed through the inside of the marker main body 51 and marking is performed on the head 81 of the screw 80 by the seeping ink to the marking section 53 at the tip thereof. Thus, the clogging of ink does not occur.

In the bit 70, a first marker guide groove 72 with a generally-semicircular cross-section, into which the marker main body 51 is slidably fitted, is formed on one side surface of the bit main body 71 along the axial direction over the entire length of the bit main body 71.

In the present embodiment, the marker main body 51 is disposed by utilizing the first marker guide groove 72 formed on the side surface of the bit main body 71. Thus, the marker 54 can be disposed easily, there is no need to form, in the bit, a shaft hole for an ink as in a conventional technique, and the marker main body 51 can be attached with simple processing such that the first marker guide groove 72 is formed.

A pair of second marker guide grooves 65 for slidably guiding the marker main body 51 fitted with the first marker guide groove 72 of the bit 70 are formed in the inner diameter portion 64 on the tip side of the coupler 60 so as to be symmetrical with respect to the central axis. Although a single second marker guide groove 65 will suffice for the purpose, since an attachment phase of the bit 70 is limited to one, the attachment phases of the bit 70 are set at two positions by providing one more groove so as to be symmetrical with respect to the central axis.

The marker section 50 with the above-described configuration is configured such that the marker main body 51 is inserted into the inner diameter portion 64 on the tip side of the coupler main body 61 with the marker main body 51 being aligned with the second marker guide groove 65 while the marker main body 51 is fitted into the first marker guide groove 72 of the bit main body 71 and the first spring 55 is placed between the ink tank section 52 and the bit main body 71. Thus, the bit 70 can be replaced easily, and replacement of the marker section 50 or refilling of an ink can be performed easily.

Note that the second spring 56 may be attached on the side of the activating rods 48 in advance or it may be attached to the ink tank section 52.

If the bit main body 71 is inserted into the coupler main body 61 up to a predetermined position, a ball for engagement, for example, is engaged with a peripheral groove portion of the bit main body, thereby preventing the bit main body 71 from coming off. While keeping such a state, the marking section 53 is positioned at a place more posterior than the tip of the bit main body 71 so as to be opposed to the head 81 of the screw 80 with a distance.

As described above, the tightening of the screw 80 is started with the torque driver 1 from the state of FIG. 1 before the tightening is performed. When the set torque value is achieved by the tightening of the screw 80, the activating member 46 of the marker activating section 40 instantaneously moves toward the tip side by receiving the repulsive force due to the magnetic forces of the first permanent magnets 45*a* and the second permanent magnets 45*b*. As a result, the marking section 53 is brought into contact with the head 81 of the screw 80, thereby marking the contacted portion.

The portion at which the marking is performed is on the head 81 of the screw 80 but lateral to a portion at which the tip portion of the bit 70 is engaged. Thus, it is possible to see the marking position easily and it is possible to perform marking without a failure.

Upon the marking, by pushing the ink tank section 52 through the second spring 56 while compressing the first spring 55, the marker main body 51 is moved toward the tip side. Thus, even when the activating member 46 is moved toward the tip side with the marking section 53 being in contact with the head 81 of the screw 80, the second spring 56 absorbs this excess travel distance made by the activating member 46, thereby preventing breakdown of the marker activating section 40 and the marker section 50.

Moreover, when the torque limiter is activated (when the load torque becomes equal to or smaller than the set torque), the relationship between the case 10 and the main shaft 20 returns to the first phase position and the activating member 46 is returned to the original position by the spring force of the first spring 55 and the attraction force such that the second permanent magnets 45*b* are attracted to the third permanent magnets 45*c* by the magnetic force.

Figure 9A:
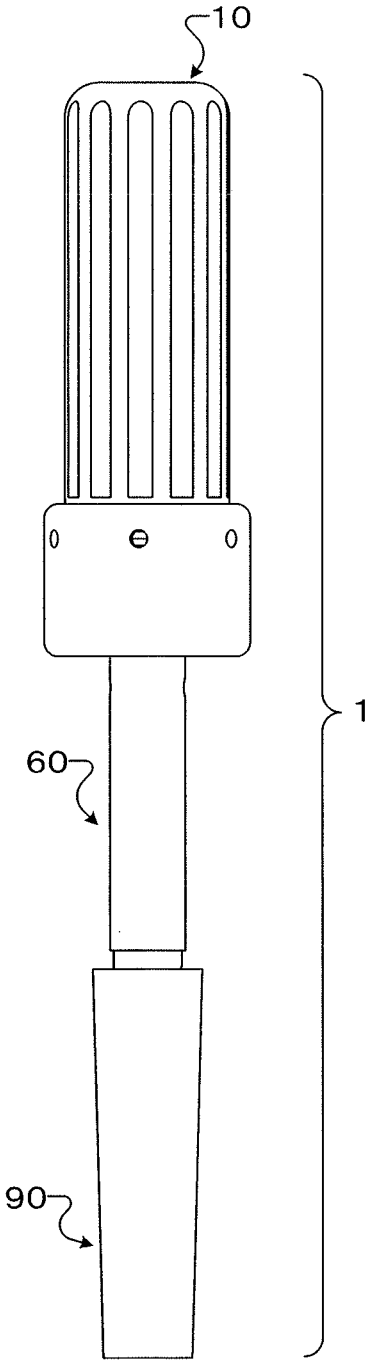
FIG. 9 shows a state where a cap is attached to the marker of the torque driver with a marker in FIG. 1, wherein (a) shows an external view thereof and (b) shows a longitudinal cross-sectional view thereof.
Figure 9B:
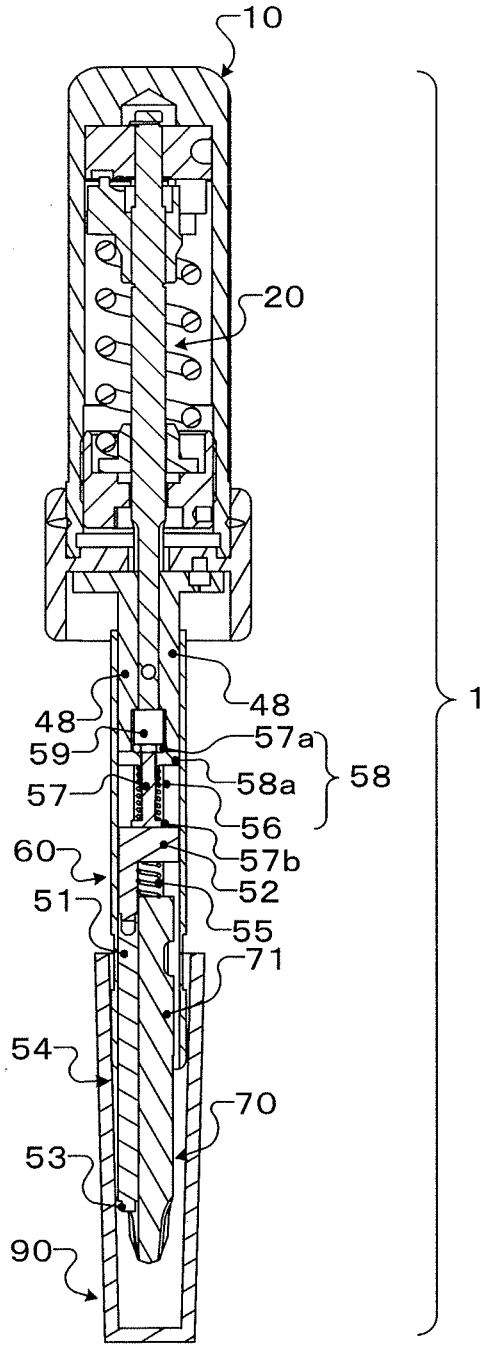

When the torque driver 1 with a marker is not being used, a cap 90 is attached to the tip portion thereof so as to prevent the marking section 53 from being dried as shown in FIG. 9. The cap 90 is attached so as to cover up to the tip portion of the coupler 60. Since the present embodiment is configured such that the marker main body 51 is accommodated within the cylindrically-shaped coupler 60, it is only necessary to form the inside of the cap 90 in a cylindrical shape matched with the outer periphery of the coupler main body 61.

Although the cap 90 is attached so as to cover up to the coupler main body 61, it may be attached so as to cover up to the bit 70 and the marker main body 51.

The tips of the pair of activating rods 48 are in contact with one end of the second spring 56 through a spring seat 58*a* as shown in FIG. 1. However, as shown in FIG. 9, a spring unit 58 may be used, in which: the spring seat 58*a* is inserted into a guide pin 57 in a manner such that it is capable of moving in the axial direction; the second spring 56 is disposed in the guide pin 57; and stopper sections 57*a* and 57*b* are formed at both ends of the guide pin 57 in the axial direction. The spring unit 58 is disposed between the tips of the pair of activating rods 48 and the ink tank section 52. When the pair of activating rods 48 are moved toward the anterior side in the axial direction, the second spring 56 is pushed through the spring seat 58*a* and the ink tank section 52 is thereby pushed toward the anterior side in the axial direction through the stopper section 57*b*. In order to avoid interference of the stopper section 57*a* and the activating rods 48 when the second spring 56 is compressed due to the force applied to the spring seat 58*a*, the tip of the main shaft 20 at the first position is retracted to a position more posterior than the tips of the activating rods 48 and a void 59 into which the stopper section 57*a* is fitted is provided therebetween.

Second Embodiment

FIG. 7 shows a marker activating section according to the second embodiment. Note that members same as those shown in FIGS. 1 to 6 will be denoted by the same reference numerals and the description thereof will be omitted.

A marker activating section 100 of the present embodiment is configured by a multiple-thread screw portion (spiral screw portion) 101 formed on the inner peripheral wall of the front chamber 43*a* of the fixed section 41, and a notch portion 103 where a male screw portion 102 to be meshed with the spiral screw portion 101 is formed on the outer peripheral portion of the substrate 47 of the activating member 46. The spiral screw portion 101 of the present embodiment forms a triple-thread lead. As the fixed section 41 is rotated with respect to the activating member 46 from the first position toward the second position, the activating member 46 is projected toward the anterior side, thereby bringing the marking section 53 into contact with the head 81 of the screw 80. Moreover, when the torque driver 1 is removed from the screw 80, the activating member 46 is retracted into the front chamber 43*a* of the fixed section 41 by the spring force of the first spring 55, thereby drawing the marking section 53 toward the posterior side from the tip of the bit 70.

Although the spiral screw portion 101 has a triple thread, it is not limited thereto. It may have a double thread or quadruple thread or more.

Third Embodiment

FIG. 8 shows a marker activating section according to the third embodiment. Note that members same as those shown in FIGS. 1 to 6 will be denoted by the same reference numerals and the description thereof will be omitted.

A marker activating section 200 of the present embodiment is configured such that a plurality of cam faces 201 are formed at regular intervals along the circumferential direction on the inner peripheral wall of the front chamber 43*a* of the fixed section 41 instead of the spiral screw portion 101 in the second embodiment, and cam followers 202 are formed on the substrate 47 of the activating member 46 so as to be opposed to the cam faces 201.

In the present embodiment, as the fixed section 41 is rotated with respect to the activating member 46 from the first position toward the second position, the activating member 46 is projected toward the anterior side due to the abutment of the cam followers 202 with the cam faces 201, thereby bringing the marking section 53 into contact with the head 81 of the screw 80 as with the second embodiment. Moreover, when the torque driver 1 is removed from the screw 80, the activating member 46 is retracted into the front chamber 43*a* of the fixed section 41 by the spring force of the first spring 55, thereby drawing the marking section 53 toward the posterior side from the tip of the bit 70.

REFERENCE SIGNS LIST

1 torque driver with marker (torque driver)
10 case
20 main shaft
30 torque limiter section
40, 100, 200 marker activating section
45*a*, 45*b* permanent magnet
50 marker section
60 coupler
70 bit
80 screw
90 cap

The invention claimed is:

1. A torque driver comprising:
a case so as to serve as a hand grip section;
a torque limiter section disposed in the case;
a main shaft to which a tightening force applied to the case is transmitted through the torque limiter section;
a coupler fixed at a tip portion of the main shaft; and
a bit attached to a tip portion of the coupler,
wherein the case is rotated relative to the main shaft when a tightening torque on a screw engaged with the bit reaches a torque value set in the torque limiter section to activate the torque limiter section,
wherein the torque driver comprises: a marker extending from an inside of the coupler to a tip portion of the bit along a side surface of the bit; and a marker activating section that allows the marker to move forward by utilizing rotation of the case relative to the main shaft so that a tip portion of the marker contacts the screw to perform marking thereon,
wherein the marker activating section includes: a fixed section fixed to the case; a moving member disposed to be opposed to the fixed section and to be capable of moving in an axial direction and incapable of rotating about an axis with respect to the main shaft, the moving member moving forward in the axial direction so as to move the marker forward; and a plurality of permanent magnets disposed on opposing surfaces of the fixed section and the moving member with phases shifted from one another about the axis, the plurality of permanent magnets disposed on one of the opposing surfaces having magnetic poles same as those of the plurality of permanent magnets disposed on another of the opposing surfaces, and
wherein at a rotational position at which the torque value is reached in the fixed section, the plurality of permanent magnets disposed on the fixed section is positioned directly facing the plurality of permanent magnets disposed on the moving member opposed to the fixed section.

2. The torque driver according to claim 1, wherein the marker is supported between the moving member and the bit through a spring.

3. The torque driver according to claim 1, wherein the marker includes: a first marker guide groove formed on the side surface of the bit along the axial direction; a second marker guide groove formed on an inner peripheral surface of the coupler along the axial direction, the second marker guide groove being formed to be opposed to the first marker guide groove; a marker main body disposed between the first marker guide groove and the second marker guide groove so as to be capable of moving; a marking section provided to a tip portion of the marker main body and being lateral to the tip portion of the bit; and an ink tank section for accommodating an ink, provided to a posterior end of the marker main body.

4. The torque driver according to claim 1, further comprising a cap for covering the tip portion of the marker together with the bit.

* * * * *